US010474173B2

(12) United States Patent
Nakashima

(10) Patent No.: US 10,474,173 B2
(45) Date of Patent: Nov. 12, 2019

(54) VOLTAGE REGULATOR HAVING A PHASE COMPENSATION CIRCUIT

(71) Applicant: ABLIC Inc., Chiba-shi, Chiba (JP)

(72) Inventor: Shingo Nakashima, Tokyo (JP)

(73) Assignee: ABLIC INC., Chiba (JP)

( * ) Notice: Subject to any disclaimer, the term of this patent is extended or adjusted under 35 U.S.C. 154(b) by 0 days.

(21) Appl. No.: 16/057,435

(22) Filed: Aug. 7, 2018

(65) Prior Publication Data

US 2019/0050008 A1 Feb. 14, 2019

(30) Foreign Application Priority Data

Aug. 10, 2017 (JP) ..... 2017-155502

(51) Int. Cl.
*G05F 1/575* (2006.01)
*G05F 1/56* (2006.01)

(52) U.S. Cl.
CPC ..... *G05F 1/56* (2013.01); *G05F 1/575* (2013.01)

(58) Field of Classification Search
CPC ... G05F 1/10; G05F 1/56; G05F 1/565; G05F 1/575
See application file for complete search history.

(56) References Cited

U.S. PATENT DOCUMENTS 6,975,099 B2 * 12/2005 Wu ..... G05F 1/575 323/280
8,816,658 B1 * 8/2014 De Vita ..... G05F 1/575 323/275
2009/0121690 A1 * 5/2009 Imura ..... G05F 1/56 323/218
2013/0069607 A1 * 3/2013 Suzuki ..... G05F 1/575 323/271

FOREIGN PATENT DOCUMENTS

JP 2013-077288 4/2013

* cited by examiner

*Primary Examiner* — Gary L Laxton
*Assistant Examiner* — Jye-June Lee
(74) *Attorney, Agent, or Firm* — Brinks Gilson & Lione

(57) ABSTRACT

A voltage regulator is equipped with the first and the second source-grounded amplifier circuits connected to an output terminal of a differential amplifier circuit; a phase compensation circuit having a resistor part and a capacitor part, and connected between an output terminal of the first source-grounded amplifier circuit and an output terminal of the second source-grounded amplifier circuit; and an output transistor connected to the output terminal of the second source-grounded amplifier circuit. At least one of the resistor part and the capacitor part of the phase compensation circuit has a filter.

5 Claims, 4 Drawing Sheets

PRIOR ART

VOLTAGE REGULATOR HAVING A PHASE COMPENSATION CIRCUIT

RELATED APPLICATIONS

This application claims priority under 35 U.S.C. § 119 to Japanese Patent Application No. 2017-155502 filed on Aug. 10, 2017, the entire content of which is hereby incorporated by reference.

BACKGROUND OF THE INVENTION

Field of the Invention

The present invention relates to a voltage regulator.

Background Art

Generally, a voltage regulator generates a constant output voltage Vout in response to an input voltage Vin and always keeps the output voltage Vout constant against load fluctuation. Further, in order to improve the transient response characteristic, the voltage regulator is required to widen the frequency range.

FIG. 4 is a circuit of a conventional voltage regulator 400. The conventional voltage regulator 400 includes an error amplifier 41 which outputs a signal obtained by amplifying a difference between a feedback voltage Vfb corresponding to the voltage at the output terminal and a reference voltage Vref, and a phase compensation circuit 42 composed of resistors and a capacitor, and configures a three-stage amplifier circuit.

A stable operation and an improved transient response are compatible under the aforementioned circuit configuration.

Further, since the conventional voltage regulator 400 includes an output current detection circuit 43 which senses an output load current, and a switch circuit connected in parallel with the resistor of the phase compensation circuit 42, and is capable of switching the resistance value of the phase compensation circuit 42 according to the output current, it is possible to further stabilize the operation of the voltage regulator 400 (refer to, for example, Japanese Patent Application Laid-Open No. 2013-77288).

SUMMARY OF THE INVENTION

In the conventional voltage regulator 400, switching noise is generated upon switching the resistance value of the phase compensation circuit 42 when the load current changes. Thus, the voltage regulator 400 has a possibility of an unstable operation due to the switching noise.

A voltage regulator of the present invention includes: a first and a second source-grounded amplifier circuits connected to an output terminal of a differential amplifier circuit; a phase compensation circuit having a resistor part and a capacitor part, and connected between an output terminal of the first source-grounded amplifier circuit and an output terminal of the second source-grounded amplifier circuit; and an output transistor connected to the output terminal of the second source-grounded amplifier circuit. At least one of the resistor part and the capacitor part of the phase compensation circuit has a filter.

Since the phase compensation circuit is configured as described above, the voltage regulator of the present invention is capable of stable operation upon a wide range of conditions for load current.

DETAILED DESCRIPTION OF THE EMBODIMENTS

Embodiments of the present invention will hereinafter be described with reference to the accompanying drawings.

Figure 1:
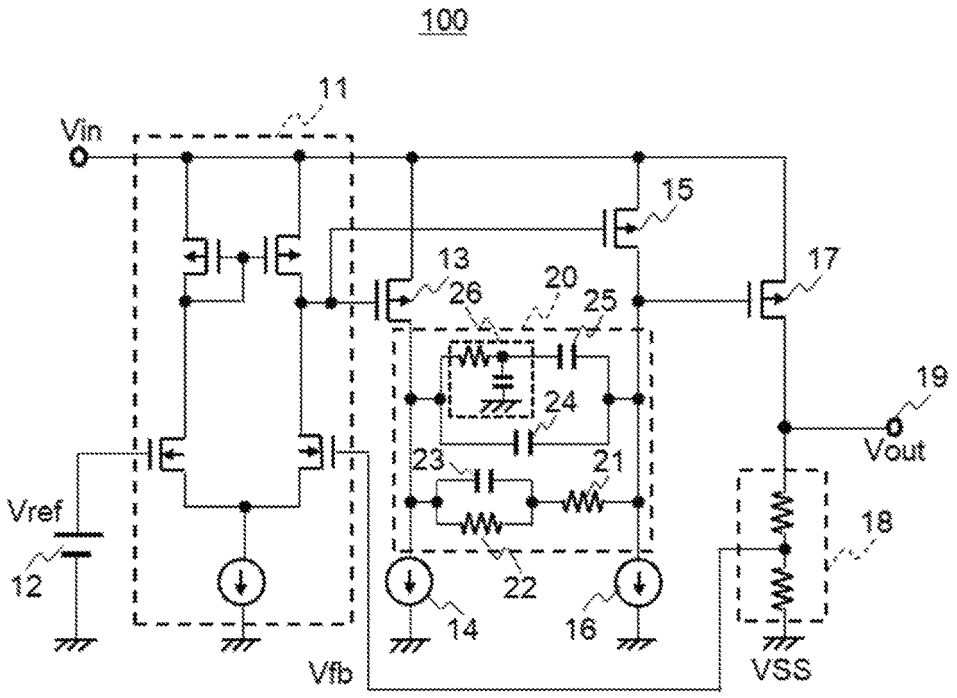
FIG. 1 is a circuit diagram of a voltage regulator according to an embodiment of the present invention.

FIG. 1 is a circuit diagram of a voltage regulator 100 according to the present embodiment.

The voltage regulator 100 is equipped with a differential amplifier circuit 11, a reference voltage circuit 12, a MOS transistor 13, a constant current source 14, a MOS transistor 15, a constant current source 16, a MOS transistor 17, a feedback circuit 18, an output terminal 19, and a phase compensation circuit 20.

The phase compensation circuit 20 is equipped with a resistor part having resistors 21 and 22 and a capacitor 23, and a capacitor part having capacitors 24 and 25 and a low-pass filter 26. The low-pass filter 26 is composed from, for example, a resistor and a capacitor.

The output transistor 17 and the feedback circuit 18 are connected in series between a power supply terminal Vin (also called "a first power supply terminal") and a ground terminal VSS (also called "a second power supply terminal").

The differential amplifier circuit 11 has a non-inversion input terminal connected to the reference voltage circuit 12 which generates a reference voltage Vref, an inversion input terminal connected to an output terminal of the feedback circuit 18, and an output terminal connected to a gate terminal of the MOS transistor 13 and a gate terminal of the MOS transistor 15.

The MOS transistor 13 and the constant current source 14 are connected in series between the power supply terminal Vin and the ground terminal VSS and configures the first source-grounded amplifier circuit. The first source-grounded amplifier circuit has an input terminal which is the gate terminal of the MOS transistor 13, and an output terminal which is a drain terminal of the MOS transistor 13.

The MOS transistor 15 and the constant current source 16 are connected in series between the power supply terminal Vin and the ground terminal VSS and configures the second source-grounded amplifier circuit. The second source-grounded amplifier circuit has an input terminal which is the gate terminal of the MOS transistor 15, and an output terminal which is a drain terminal of the MOS transistor 15. The second source-grounded amplifier circuit has the output terminal connected to a gate terminal of the MOS transistor 17.

The phase compensation circuit 20 is connected between the output terminal of the first source-grounded amplifier circuit and the output terminal of the second source-grounded amplifier circuit.

The resistor part of the phase compensation circuit 20 is configured to connect the parallel-connected resistor 22 and capacitor 23 in series to the resistor 21. The capacitor part of the phase compensation circuit 20 is configured to connect the series-connected low-pass filter 26 and capacitor 25 in parallel with the capacitor 24.

The feedback circuit 18 divides the output voltage Vout of the output terminal 19 to generate a feedback voltage Vfb. Alternatively, the feedback circuit 18 may output the output voltage Vout as the feedback voltage Vfb as it is, without dividing the output voltage Vout.

The differential amplifier circuit 11 amplifies a result of comparison between the reference voltage Vref provided from the reference voltage circuit 12 and the feedback voltage Vfb, and supplies the same to the first source-grounded amplifier circuit and the second source-grounded amplifier circuit.

Here, in the first source-grounded amplifier circuit and the second source-grounded amplifier circuit each element are set in such a manner that the voltages appearing at both ends of the phase compensation circuit 20 become equal to each other. For example, the MOS transistor 13 and the MOS transistor 15 have the same aspect ratio (W/L), and the constant current source 14 and the constant current source 16 generate current of the same magnitude. Further, for example, if the aspect ratios of the MOS transistor 13 and the MOS transistor 15 are changed, the ratio of currents of the constant current source 14 and the constant current source 16 is also changed according to the aspect ratios.

Next, the operation of the voltage regulator 100 is described.

Since the decrease of the output voltage Vout of the output terminal 19 also lowers the feedback voltage Vfb, the output voltage of the differential amplifier circuit 11 rises. Since the input voltages to the first source-grounded amplifier circuit and the second source-grounded amplifier circuit increase, the output voltages therefrom decrease.

The first source-grounded amplifier circuit controls a gate terminal of the MOS transistor 17 through the phase compensation circuit 20. The second source-grounded amplifier circuit controls the gate terminal of the MOS transistor 17. Since the output from the second source-grounded amplifier circuit does not pass through the phase compensation circuit 20, the voltage of the gate terminal of the MOS transistor 17 can be set to a desired voltage without delay.

Decrease in the output voltages of the first source-grounded amplifier circuit and the second source-grounded amplifier circuit reduces the voltage at the gate terminal of the MOS transistor 17. The MOS transistor 17 is thus biased to turn on, the output voltage Vout of the output terminal 19 rises and is held constant.

Further, by the increase in the output voltage Vout at the output terminal 19 the voltage regulator 100 operates to reduces the output voltage Vout at the output terminal 19 and to hold it constant.

Next, the operation of phase compensation of the voltage regulator 100 is next described.

The MOS transistor 17 is much larger in size than other transistors. Thus, a parasitic capacitance between the gate and drain of the MOS transistor 17 which induces Miller effect is large as compared with other transistors. Further, the capacitances of the capacitors 24 and 25 are set sufficiently small as to be negligible as compared with the parasitic capacitance between the gate and drain of the MOS transistor 17.

A pole P2 is generated by a combined resistance of output resistances of the MOS transistors 13 and 15 and a capacitance of the parasitic capacitance between the gate and drain of the MOS transistor 17. Also, a pole P3 is generated by a combined resistance of the output resistance of the MOS transistor 17 and the load resistance and a capacitance of the load capacitance which are respectively unillustrated in the drawing. Further, a zero Z1 occurs at a frequency determined by the resistance of the resistor part of the phase compensation circuit 20 and the capacitance of the capacitor part thereof.

The voltage regulator 100 loses 90 degrees from the phase margin at the pole P2 and further loses 90 degrees at the pole P3. Particularly in case that the frequencies of the poles P2 and P3 are close each other, it is not possible to ensure a phase margin, i.e., it is not possible to hold a stable operation. Accordingly, the phase margin is increased 90 degrees at the zero Z1 to thereby keep the stable operation.

Since the frequency of the pole P3 depends on the value of the load resistance and the value of the load capacitance, it changes according to a load current flowing through the output terminal 19. For example, when the load resistance is small and the load current is large, the frequency of the pole P3 becomes high, whereas when the load resistance is large and the load current is small, the frequency of the pole P3 becomes low.

Here, in the resistance part of the phase compensation circuit 20, the capacitor 23 connected in parallel with the resistor 22 functions as a high-pass filter. In a band lower than the cutoff frequency of the high-pass filter, the resistance of the resistance part of the phase compensation circuit 20 comes to a total of the resistance of the resistors 21 and 22. Further, in a band higher than the cutoff frequency of the high-pass filter, the resistance of the resistance part of the phase compensation circuit 20 becomes the resistance of the resistor 21.

Thus, the frequency of the zero Z1 goes high in the band higher than the cutoff frequency of the high-pass filter. Accordingly, the voltage regulator 100 is capable of making the frequency of the zero Z1 high according to increase of the frequency of the pole P3 caused by increase of the load current.

Further, the capacitor part of the phase compensation circuit 20 is configured to connect the low-pass filter 26 in series to the capacitor 25. In a band lower than the cutoff frequency of the low-pass filter, the capacitance of the capacitor part of the phase compensation circuit 20 comes to a total of the capacitance of the capacitors 24 and 25. Also, in a band higher than the cutoff frequency of the low-pass filter, the capacitance of the capacitor part of the phase compensation circuit 20 becomes the capacitance of the capacitor 24.

Thus, the frequency of the zero Z1 goes low in the band lower than the cutoff frequency of the low-pass filter. Accordingly, the voltage regulator 100 is capable of making the frequency of the zero Z1 low according to decrease of the frequency of the pole P3 caused by decrease of the load current.

As described above, since the zero Z1 can be generated in an appropriate band even if the frequency of the pole P3 is shifted due to the shift in load current, the voltage regulator 100 is capable of keeping a stable operation. Thus, the voltage regulator 100 is capable of stable operation in a wide range of load current condition.

Figure 2:
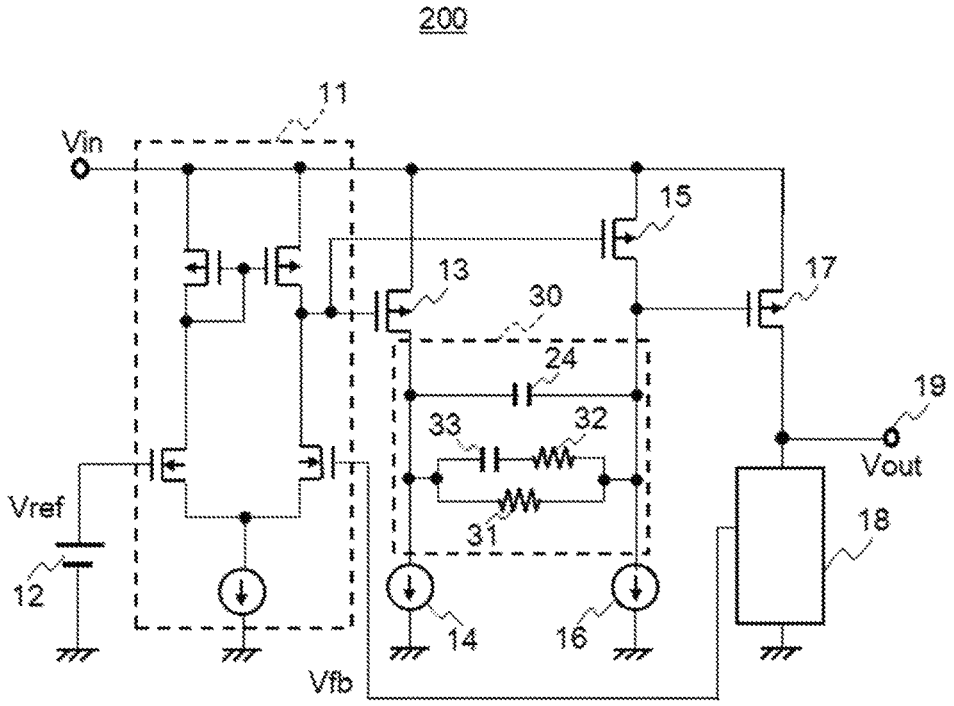
FIG. 2 is a circuit diagram illustrating another example of the voltage regulator according to the embodiment of the present invention.

Incidentally, although the resistor part of the phase compensation circuit 20 is configured to connect the parallel-connected resistor 22 and capacitor 23 in series to the resistor 21, the resistor part is not limited to it. As in a phase compensation circuit 30 of a voltage regulator 200 illustrated in FIG. 2, a resistor 32 connected in series to a capacitor 33 being a high-pass filter may be connected in parallel with a resistor 31.

Figure 3:
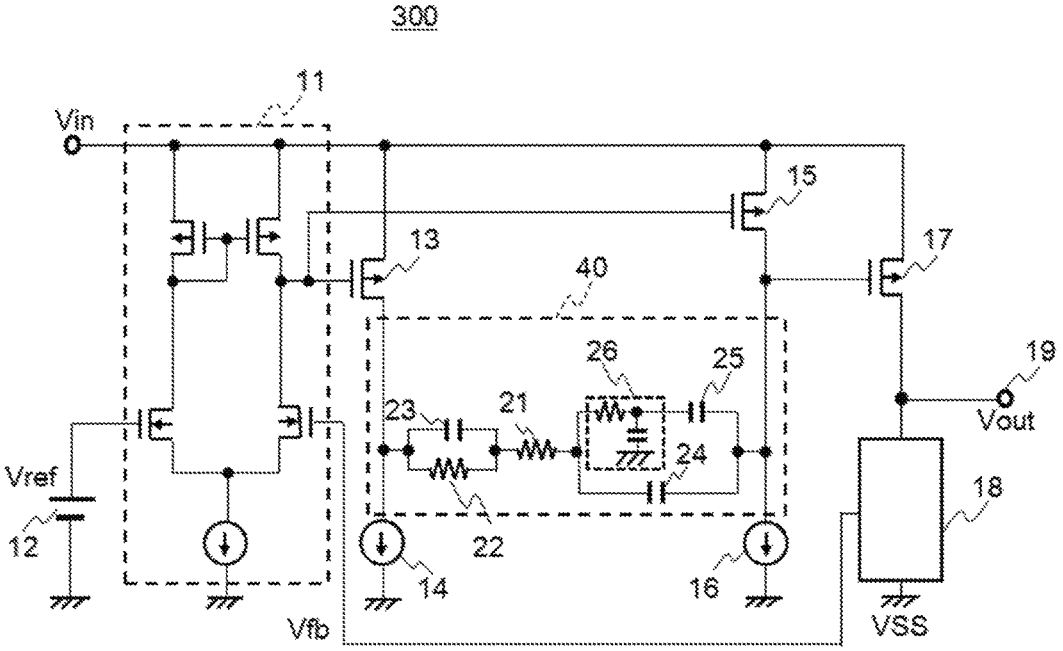
FIG. 3 is a circuit diagram illustrating a further example of the voltage regulator according to the embodiment of the present invention.
Figure 4:
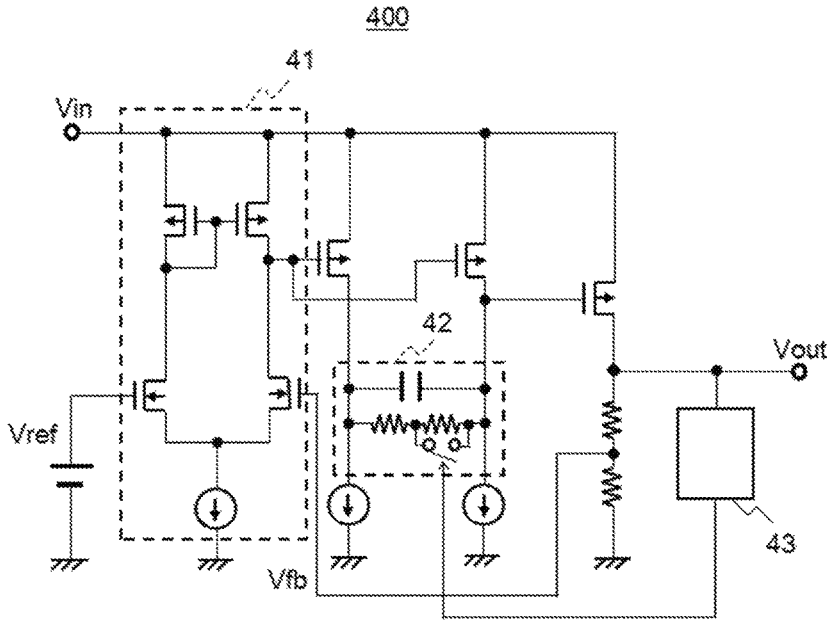
FIG. 4 is a circuit diagram of a conventional voltage regulator.

Also, although the phase compensation circuit 20 has been described as the configuration in which the resistor part and the capacitor part are connected in parallel, the phase compensation circuit 20 is not limited to this configuration. As in a phase compensation circuit 40 of a voltage regulator 300 illustrated in FIG. 3, for example, a similar effect can be obtained even in a configuration in which a resistor part and a capacitor part are connected in series.

Further, the phase compensation circuit may be configured in such a manner that the frequency of the zero Z1 in each embodiment becomes low against large load current. In this case, the resistor part of the phase compensation circuit 20 may be configured to have the first and second resistors connected in parallel, and a low-pass filter connected in series to the second resistor, for example.

Although the embodiments of the present invention have been described above, the present invention is not limited to the above embodiments. It is needless to say that various changes can be made thereto within the scope not departing from the gist of the present invention.

For example, the phase compensation circuits in the above-described respective embodiments may be configured singly or in combination as needed.

What is claimed is:

1. A voltage regulator, comprising:

a differential amplifier circuit configured to amplify a difference between a reference voltage and a feedback voltage both provided to the differential amplifier circuit, and to supply an amplified difference;

a first source-grounded amplifier circuit connected to an output terminal of the differential amplifier circuit;

a second source-grounded amplifier circuit connected to the output terminal of the differential amplifier circuit;

a phase compensation circuit having a resistor part and a capacitor part, and connected between an output terminal of the first source-grounded amplifier circuit and an output terminal of the second source-grounded amplifier circuit; and an output transistor connected to the output terminal of the second source-grounded amplifier circuit, at least one of the resistor part and the capacitor part in the phase compensation circuit including a filter, and wherein the capacitor part includes a first capacitor and a second capacitor connected in parallel, and the filter comprises a low-pass filter connected in series to the second capacitor, the low pass filter comprising a resistor and a third capacitor having a terminal connected to ground.

2. The voltage regulator according to claim 1, wherein the resistor part of the phase compensation circuit includes a first resistor and a second resistor connected in series, and a high-pass filter connected in parallel to the second resistor.

3. The voltage regulator according to claim 1, wherein the resistor part of the phase compensation circuit includes a first resistor and a second resistor connected in parallel, and a high-pass filter connected in series to the second resistor.

4. A voltage regulator comprising:

a differential amplifier circuit configured to amplify a difference between a reference voltage and a feedback voltage both provided to the differential amplifier circuit, and to supply an amplified difference;

a first source-grounded amplifier circuit connected to an output terminal of the differential amplifier circuit;

a second source-grounded amplifier circuit connected to the output terminal of the differential amplifier circuit;

a phase compensation circuit having a resistor part and a capacitor part, and connected between an output terminal of the first source-grounded amplifier circuit and an output terminal of the second source-grounded amplifier circuit; and an output transistor connected to the output terminal of the second source-grounded amplifier circuit, at least one of the resistor part and the capacitor part in the phase compensation circuit including a filter;

wherein the capacitor part of the phase compensation circuit includes a first capacitor and a second capacitor connected in parallel, and the filter comprises a low-pass filter connected in series to the second capacitor, the low pass filter comprising a resistor and a third capacitor having a terminal connected to ground.

5. A voltage regulator comprising:

a differential amplifier circuit configured to amplify a difference between a reference voltage and a feedback voltage both provided to the differential amplifier circuit, and to supply an amplified difference;

a first source-grounded amplifier circuit connected to an output terminal of the differential amplifier circuit;

a second source-grounded amplifier circuit connected to the output terminal of the differential amplifier circuit;

a phase compensation circuit having a resistor part and a capacitor part, and connected between an output terminal of the first source-grounded amplifier circuit and an output terminal of the second source-grounded amplifier circuit;

an output transistor connected to the output terminal of the second source-grounded amplifier circuit, at least one of the resistor part and the capacitor part in the phase compensation circuit having a filter, and wherein the resistor part of the phase compensation circuit includes a first resistor and a second resistor connected in parallel, and a low-pass filter connected in series to the second resistor.

* * * * *